United States Patent [19]

Luckey

[11] 4,142,718

[45] Mar. 6, 1979

[54] TABLE TENNIS TABLE

[75] Inventor: Franz Luckey, Thayngen, Switzerland

[73] Assignee: Swiss Aluminium Ltd., Chippis, Switzerland

[21] Appl. No.: 714,716

[22] Filed: Aug. 16, 1976

[30] Foreign Application Priority Data

Sep. 10, 1975 [CH] Switzerland ..... 11752/75

[51] Int. Cl.[2] ..... A63B 71/04

[52] U.S. Cl. ..... 273/30

[58] Field of Search ..... 108/67, 160; 273/30, 273/3 R, 6, 3 A; 428/461, 462

[56] References Cited

U.S. PATENT DOCUMENTS

| | | | |
|---|---|---|---|
| 1,995,543 | 3/1935 | Kaser | 273/30 |
| 2,023,844 | 12/1935 | Kleinman | 273/30 |
| 2,993,806 | 7/1961 | Fischer et al. | 428/463 X |
| 3,392,045 | 7/1968 | Holub | 428/461 X |
| 3,858,877 | 1/1975 | Lundstrom | 273/30 X |

FOREIGN PATENT DOCUMENTS

| | | | |
|---|---|---|---|
| 221790 | 11/1961 | Austria | 428/461 |
| 784500 | 4/1935 | France | 273/30 |
| 1494295 | 7/1967 | France | 273/30 |
| 153863 | 4/1932 | Switzerland | 273/30 |

*Primary Examiner*—William H. Grieb
*Assistant Examiner*—T. Brown
*Attorney, Agent, or Firm*—Bachman & LaPointe

[57] ABSTRACT

A weatherproof table tennis table, includes a table top and an integrally made bent lateral rim. It consists of a composite plate of a thermoplastic plastics core and two metal facing sheets, a rectangular-shaped frame, and brackets for folding legs, the frame and brackets being connected rigidly to the rim.

5 Claims, 1 Drawing Figure

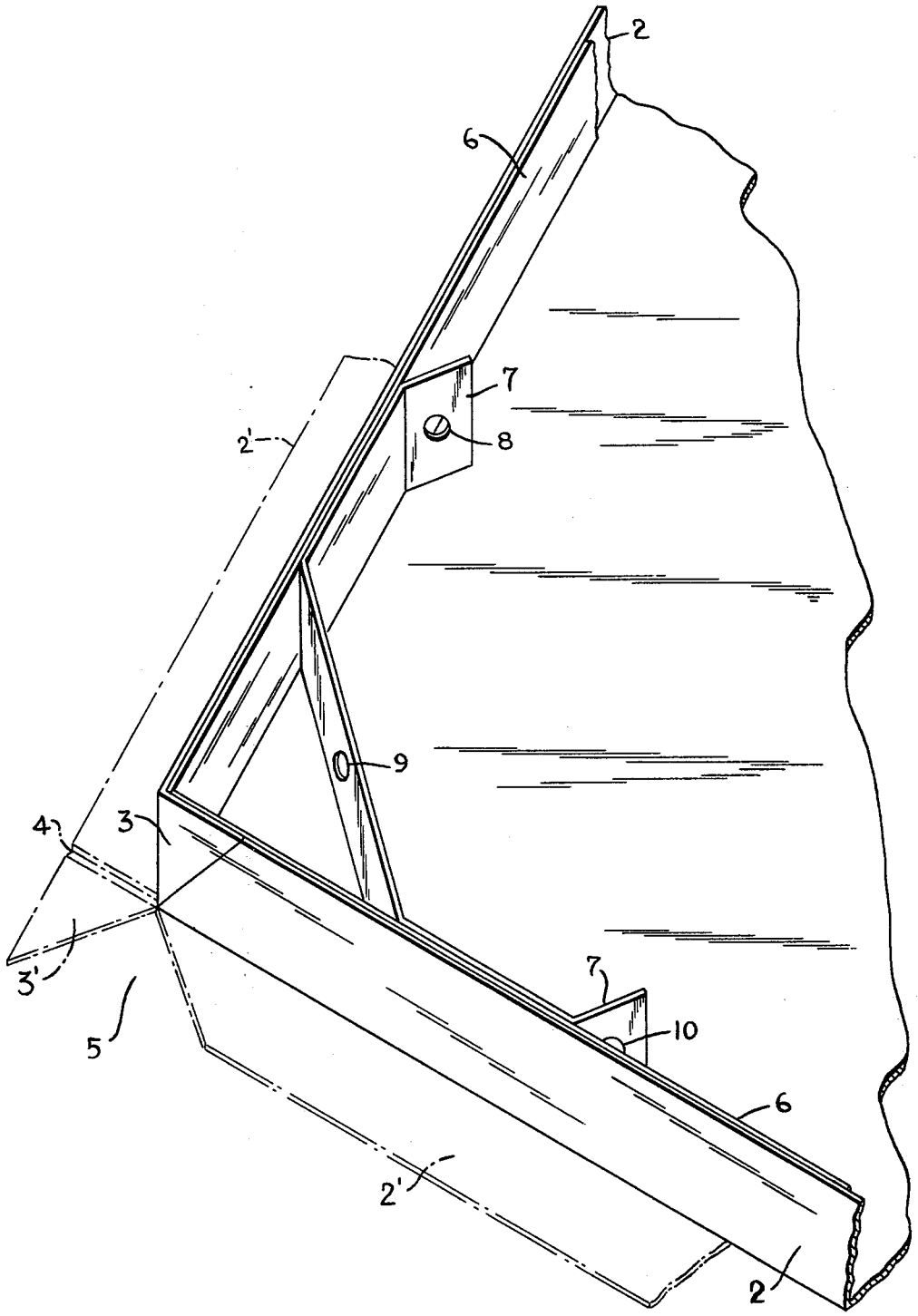
2
6
7
8
2'
9
4
3
3'
5
7
10
6
2'
2

TABLE TENNIS TABLE

BACKGROUND OF THE INVENTION

Hitherto table tops for table tennis tables have been made not only of wood but also of plastics, especially unsaturated polyester resins reinforced with glass fibres, of metals, especially steel or aluminum, of concrete and of asbestos cement.

For some time, the market has indicated a need for weatherproof table tennis tables, which can stay in the open air during the summer season, or the whole year round, without suffering any damage in their external appearance, their mechanical and static properties, and their playing behaviour (ball bounce) due to the effect of weather.

Hitherto, table tennis tables having tops of wood and/or plastics, have been damaged in relatively short periods due to weather while remaining in the open air, the damage appearing in the form of cracks, yellow discalanation and deformation.

Table tops of metal, concrete and asbestos cement have the significant disadvantage of a very great weight, and are therefore mostly mounted in a fixed position. Moreover the bouncing behaviour of table tennis balls on such tops is often unsatisfactory and does not meet the regulations of the International Table Tennis Association. Tops of asbestos cement have moreover a restricted flexibility, which leads to cracks and splintering caused by local stresses and impacts thin concrete tops frequently suffer the same damage.

SUMMARY OF THE INVENTION

It is therefore an object of the present invention to provide a table tennis table which is weatherproof and relatively light, is impact and stress resistant against loading, and which meets the regulations of the International Table Tennis Association for playing behaviour.

According to the present invention, the weather proof table and its top includes in combination a rigid frame which has upright side portions, a top plate composed of a thermoplastic portion of two metal facing sheets, the plate having a top surface serving as a playing surface of predetermined dimensions, and a rear surface, a plurality of rim portions integral with the top plate, and wherein the top plate and the rim portions have been cut out from a blank for the top sheet to cover the frame, and for the rim portions to be bent and then secured to at least some of the frame side portions to impart a box-shape to the top plate and the rim portions without the occurrence of any overlap between the rim portions secured to the frame.

The rim portions have preferably been cut out from the blank so that the box-shaped top plate and the rim portions are formed with smooth edges, and the material of at least one of the sheets has been removed from the blank on a surface thereof including the rear surface of the top plate along longitudinal lines defining the predetermined surface prior to securing the rim portions to the rigid frame so as to facilitate the bending of the rim portions.

Upon removal of the material, the blank is preferably formed with V-shaped grooves along the longitudinal lines, and brackets are preferably fitted within the rigid frame and secured thereto for receiving legs, which may be connected to the brackets. Each of the brackets has preferably a plurality of connecting regions for the legs, and the frame is preferably made of steel.

In a process of fabricating a weather proof table tennis top, the steps include fabricating a composite plate of a thermoplastic core sheet and two metal facing sheets, the plate having a top surface serving as a playing surface and a rear surface, cutting the plate to a shape exceeding the dimensions of a predetermined, substantially rectangular playing surface by a predetermined border region, removing material of at least one of the sheets from the rear surface substantially along longitudinal lines defining the predetermined surface, removing a predetermined portion from the border region of the plate in the vicinity of at least some of the intersections of the lines, and bending portions of the border region substantially along the lines in a direction towards the rear surface for the table tennis top to be box-shaped, to form a substantially rectangular playing surface, and to have rim portions bent away from the playing surface.

It is preferable if the steps include fitting and securing a rigid frame within the box-shaped table top and the rim portions, respectively, and fitting a plurality of brackets within the rigid frame for receiving legs which may be connected to the brackets.

The legs of the table may be fastened to the brackets at three points. By reason of such triangular fastening in the corners of the frame, these legs can provide very good rigidity and stability to the entire table tennis table.

For the core of the composite plate preferred materials are polyethylene or polyvinyl chloride, in a thickness within the range of 2 mm to 7 mm, while the facing sheets of the composite plate preferably consist of aluminum or an aluminum alloy, in thickness range from 0.3 to 1 mm, preferably 0.5 mm. The facing sheets are secured to the core by an adhesive.

BRIEF DESCRIPTION OF THE DRAWING

The accompanying drawing illustrates the invention in greater detail.

FIG. 1 shows a corner of a table tennis table, seen from below, in perspective;

DESCRIPTION OF THE PREFERRED EMBODIMENTS

A suitable method of manufacture of the table is as follows:

The composite plate, stove enamelled green or red on one side, is cut out to the dimensions of a playing surface 1 (1525 × 1370 mm) plus a surrounding border 2', e.g. 50 mm at all sides, and the lines of the playing surface are applied in white color. For this purpose, both imprinting colors or adherent plastics strips can be used.

V-shaped slots 4 are machined in the rear surface of the composite plate, and are spaced according to the dimensions of the playing surface (1525 × 1370 mm). The slots extend through the rear facing sheet and the core, and terminate at the other facing sheet of the composite plate.

Triangular pieces 5 of the composite plate are cut away. The recesses remaining extend to the points of intersection of the four machined grooves.

The rims 2' of the plate are bent, by bending the facing sheet which is still present at the grooves 4 so that four lateral rim parts of the table 2 are produced. The points 3' produced by removal of the triangular pieces 5 are bent until disposed at the positions 3 and then riveted to the steel frame 6 so that smooth corners of the rim are provided, which do not pose any risk of injury.

A steel frame 6 of galvanised structural steel strip of 1 to 2 mm thickness in the shape of one or two rectangles of individual strips or strips welded together in rectangular shape, is fitted within the bent-down rim of the composite plate. Steel strip brackets 7 having three fastening regions 8, 9, 10 for the legs are fitted at the corners of the composite plate. This is followed by riveting or fastening together of the composite plate rim, steel frame and leg brackets.

The result is a weatherproof, rigid table tennis top, which is stable in shape and which corresponds, as far as bouncing and general playing behavior for table tennis balls is concerned to the regulations of the International Table Tennis Association.

Folding legs of steel tube can be secured to turn and be easily detached from the three regions 8, 9, 10 of each of the brackets 7 respectively.

The two halves of a weatherproof table tennis table manufactured according to the above method can be placed together and connected by means of a clamping strip of wood or metal applied to the rim from below. A mounting bracket for a net can be fastened to this clamping strip.

Alternatively, the two halves of the table tennis table can be connected together by means of hinges, which are fastened to the two rim halves respectively.

Due to good rigidity of the table halves, these can also be placed so as to contact one another without any special connecting means.

What is claimed is:

1. A weatherproof table tennis top, comprising in combination:

a flat top plate composed of a flat thermoplastic core sheet and two flat metal facing sheets, the plate having a top surface serving as a playing surface, a plurality of rim portions integral with said top plate and subtending a predetermined angle therewith for imparting a box-shape thereto, a steel frame fitted within the box-shaped top plate and said rim portions, and secured to at least said rim portions, and a plurality of brackets fitted within said steel frame and secured thereto for receiving legs to be connected to said brackets.

2. A weatherproof table tennis top comprising in combination:

a rigid frame having upright side portions, and a flat top plate including a plurality of bent rim portions depending from, and integral with, said top plate, said top plate and said rim portions being formed from a single blank composed of a flat thermoplastic core sheet and two flat metal facing sheets and having two major surfaces, one of the surfaces being a top surface serving as a playing surface of predetermined dimensions, and the other of the surfaces being the underside, said top plate covering said frame, and said rim portions being bent and then secured to at least some of the frame side portions to impart a box-shape to said top plate and said rim portions, free from any overlap between the rim portions secured to said frame.

3. A weatherproof table tennis top according to claim 2, wherein said rim portions have been cut out from the blank so that the box-shaped top plate and the rim portions are formed with smooth edges.

4. A weatherproof table tennis top according to claim 2, further comprising a plurality of brackets fitted within said rigid frame and secured thereto for receiving legs connectable to said brackets.

5. A weatherproof table tennis top according to claim 4, wherein each of said brackets has a plurality of connecting regions for the legs.

* * * * *